United States Patent [19]

Katzman et al.

[11] 4,304,063

[45] Dec. 8, 1981

[54] ANIMATED DOLL

[75] Inventors: Allison W. Katzman, Chicago; Donald F. Nix, Hanover Park; Burton C. Meyer, Downers Grove, all of Ill.

[73] Assignee: Marvin Glass & Associates, Chicago, Ill.

[21] Appl. No.: 119,750

[22] Filed: Feb. 8, 1980

[51] Int. Cl.[3] ..... A63H 29/16

[52] U.S. Cl. ..... 46/44; 46/135 R; 46/171

[58] Field of Search ..... 46/135 R, 165, 166, 46/167, 170, 171, 36, 37, 44

[56] References Cited

U.S. PATENT DOCUMENTS

| | | | |
|---|---|---|---|
| 1,403,515 | 1/1922 | Mathews | 46/135 R X |
| 1,419,136 | 6/1922 | Hauck | 46/135 R X |
| 1,617,687 | 2/1927 | Munson | 46/135 R X |
| 3,882,631 | 5/1975 | Goldfarb et al. | 46/135 R X |
| 4,124,952 | 11/1978 | Terzian | 46/44 |

FOREIGN PATENT DOCUMENTS

| | | | |
|---|---|---|---|
| 374480 | 4/1923 | Fed. Rep. of Germany | 46/135 R |

*Primary Examiner*—F. Barry Shay

*Attorney, Agent, or Firm*—Mason, Kolehmainen, Rathburn & Wyss

[57] ABSTRACT

A figure toy is disclosed including apparatus for retaining the eyes alternatively in an eye open position or an eye closed position. The toy includes eyeball means disposed behind eyeball openings in the head and are longitudinally moveable with respect to the toy to an eye open position or an eye closed position and means are provided for longitudinally moving the eyeball means alternatively to an eye open position or an eye closed position. The eyeball means are mechanically retained in an eye open position until the bladder, forming the body portion of the doll, is compressed thereby expanding a bellows to longitudinally move the eyeball means to a position above or below the eye openings in the doll's head to simulate an eye closed position. When the eyeball means are in an eye closed position, a pin member or other retaining means can be inserted into the doll's mouth to engage a pin receiving member structurally connected to the eyeball means to maintain the eyeball means in the eye closed position until the pin member is removed from the mouth. When the pin or other retaining means is removed, the eyeball means will revert to its naturally biased longitudinal position to again simulate an eye open position.

10 Claims, 9 Drawing Figures

12
22
20
10
62
84
20

22
20
82
84
12
20

76
24
18
72
22
70
78
34
40
28
32
38
20
46
44
26
48
42
64
56
50
54
12
62
63
14
80
16

12
76
24
18
46
72
74
22
70
40
78
20
28
32
42
34
48
44
82
64
56
50
54
63
14
16
80

12
76
24
18
72
22
34
70
78
74
32
38
28
40
20
46
82
48
44
64
42
54
62
63
14
16

ANIMATED DOLL

BACKGROUND OF THE INVENTION

1. Field of the Invention

The present invention relates to a figure toy, for example a baby doll, including apparatus for retaining the eyes of the doll alternatively in an eye open position or an eye closed position and, more particularly, to a baby doll whose eyes close by squeezing or compressing a bellows retained within the doll's body. The eyes remain closed when a pacifier or other retaining means is inserted into the doll's mouth while the eyes are in a closed position.

2. Description of the Prior Art

Various dolls have been provided which include spherical eyeballs and include apparatus for rotating the spherical eyeballs to assimilate various natural eye movements. Two of these patents are to Ryan et al. U.S. Pat. Nos. 3,353,296, and 3,364,618. These patents include relatively complicated mechanisms and include electrical driving means for rotating the spherical eyeballs. The device of the present invention includes flat eyeball means which are longitudinally moveable with respect to the figure toy, or doll and the eyeballs can be retained in an eye closed position by insertion of a pacifier or other pin member into the mouth of the figure toy or doll to engage a pin receiving member disposed within the doll to maintain the eyes in a closed position until the pin member is removed.

OBJECTS OF THE PRESENT INVENTION

Accordingly, it is an object of the present invention to provide a figure toy, or doll having longitudinally moveable eyeballs moveable to both eye open and eye closed positions and including apparatus for retaining the eyes alternatively in both positions.

Another object of the present invention is to provide a new and improved figure toy or baby doll having flat eyeball means disposed in an eye open position behind transparent eyeball covering members which eyeball means are longitudinally moveable to a hidden position below or above said eyeball means covering members to simulate an eye closed position.

Another object of the present invention is to provide a new and improved figure toy or doll having eyeball means longitudinally moveable to an eye closed position and a retaining means insertable within said figure toy or doll to engage a retaining means receiving member within the doll to maintain the eyeballs in an eye closed position until the retaining means is removed from the doll.

Another object of the present invention is to provide a new and improved figure toy or doll including eyeball means which are mechanically longitudinally moveable in response to a squeezing or compressing force against a portion of the body of the figure toy or doll.

Another object of the present invention is to provide a new and improved figure toy or doll including longitudinally moveable flat eyeball members having hemispherical, transparent eyeball covers to simulate spherical eyeballs.

SUMMARY OF THE INVENTION

The foregoing and other objects and advantages of the present invention are accomplished in a new and improved figure toy or doll including apparatus for retaining the eyes of the figure toy or doll alternatively in an eye open position or an eye closed position. In brief, the figure toy or doll includes a head portion, including eye openings on an opaque face, connected through a neck plug or structural support member to a body portion formed of a hollow bladder which may be covered with clothing and filled with stuffing between the clothing and the bladder and include arms and legs to simulate a real figure. Eyeball means are disposed behind the eyeball openings in the head and are mechanically retained in an eye open position until the bladder, forming the body portion of the doll, is compressed thereby expanding a bellows to longitudinally move the eyeball means to a position above or below the eye openings in the doll's head to simulate an eye closed position. When the eyeball means are in an eye closed position, a pin member or other retaining means can be inserted into the doll to engage a pin receiving member structurally connected to the eyeball means to maintain the eyeball means in the eye closed position until the pin member is removed. When the pin or other retaining means is removed, the eyeball means will revert to its naturally biased longitudinal position to again simulate an eye open position if the bladder is not compressed.

DESCRIPTION OF THE PREFERRED EMBODIMENT

Figure 3:
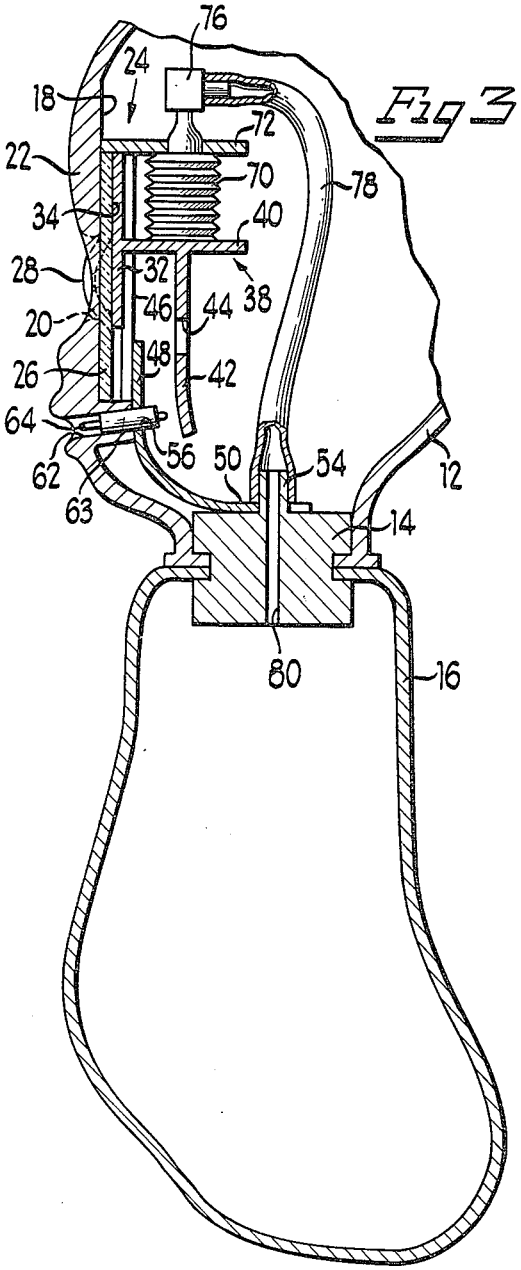
FIG. 3 is a longitudinal cross-sectional view taken through the doll's head and bladder portion with the eyeball means in an eye open position.

Referring now to the drawings, there is illustrated a new and improved figure toy or doll 10 constructed in accordance with the principles of the present invention. Referring now to FIG. 3, the doll 10 generally includes a head 12 connected through a structural neck plug or structural support member 14 to a hollow bladder 16 which forms the body portion of the doll 10. A flat inner surface 18 of the doll's head located behind eyeball openings 20 in the doll's face 22 is formed flat to accommodate a flat longitudinally moveable eyeball means generally designated by reference numeral 24.

Figure 7:
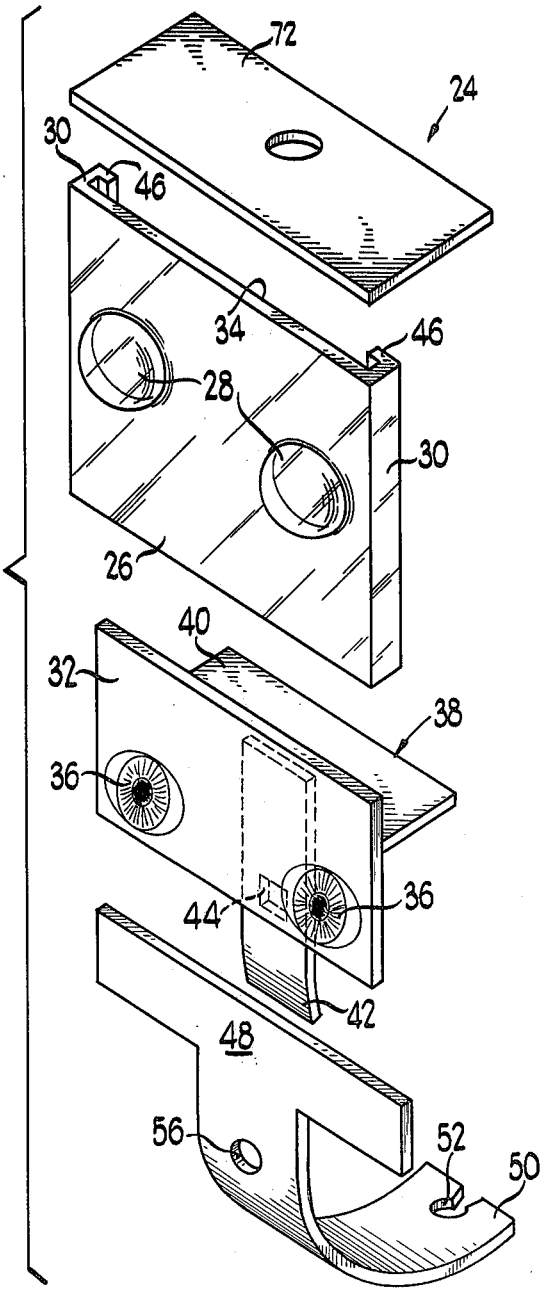
FIG. 7 is an exploded front view showing the various parts of the eyeball means and various structural components for retaining the eyeball means in a desired eye closed or eye open position.
Figure 8:
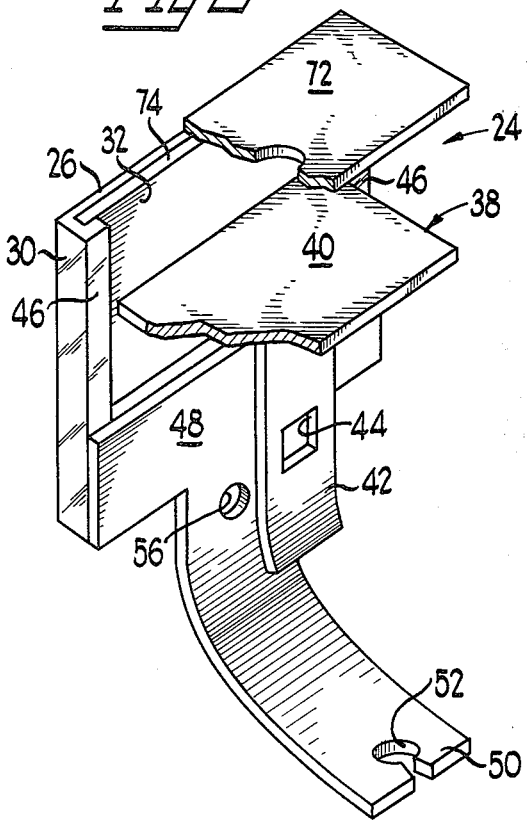
FIG. 8 is a perspective rear view of the eyeball means and associated structure.

As best shown in FIGS. 7 and 8, the eyeball means 24 includes a stationary eyeball alignment housing 26 secured against the flat interior surface 18 behind the face 22. The eyeball alignment housing 26 includes two hemispherical transparent eyeball covers 28 aligned to fit within the eye openings 20 in the doll's head 12. The eyeball alignment housing 26 includes U-shaped side edges or sidewalls 30 for retaining an eyeball slide means 32 in longitudinal slideable engagement against an interior surface 34 of the stationary eyeball alignment housing 26. Thus eyeball slide means 32 is supported for longitudinal movement by support means which includes eyeball alignment housing 36. The U-shaped sidewalls 30 permit the eyeball slide means 32 to move longitudinally upwardly and downwardly within the eyeball alignment housing 26 but do not permit the eyeball slide means 32 to travel sideways or transversely so that the eyeball slide means 32 is maintained in proper alignment to position the eyeballs 36 in proper longitudinal alignment behind the hemispherical eyeball cover means 28 and eyeball apertures 20 of the doll's head 22. The eyeballs 36 are flat, being painted or otherwise illustrated on the surface of the eyeball slide means 32, and the hemispherical transparent eyeball covers 28 have the effect of making the flat eyeballs 36 appear to be spherical. The eyeball slide means 32 has a T-shaped cross member 38 secured thereto or as an integral part of the eyeball slide 32 and the cross member 38 travels longitudinally with the eyeball slide 32. The T-shaped cross member 38 comprises a cross member 40 perpendicularly secured to a back surface of eyeball slide 32 and an elongated leg portion 42 perpendicularly secured to a bottom surface of cross member 40, as shown in FIG. 8. The elongated leg member 42 is spaced apart from the back surface of the eyeball slide 32 and lies in a plane generally parallel to the plane of the eyeball slide 32. The elongated leg member 42 includes a pin receiving aperture 44 so that when a pin member is inserted into aperture 44, the eyeball slide means will be maintained in an eye closed position.

Figure 4:
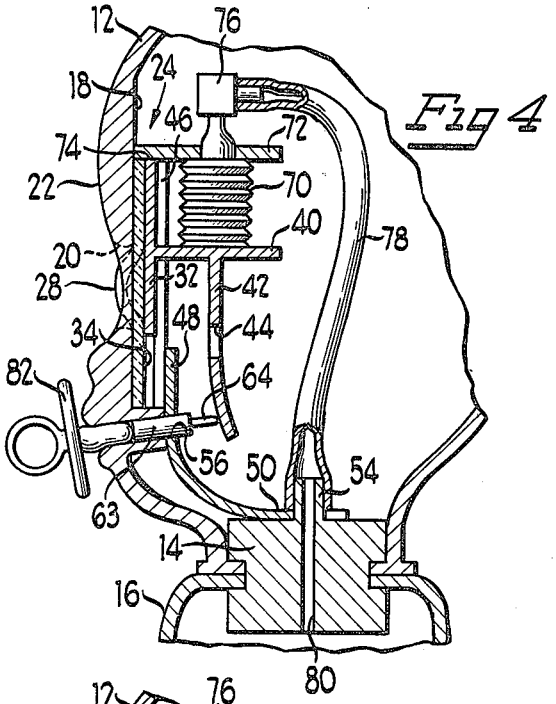
FIG. 4 is a side cross-sectional view taken through the doll's head with the eyes in an open position and with a pacifier inserted in the doll's mouth.
Figure 5:
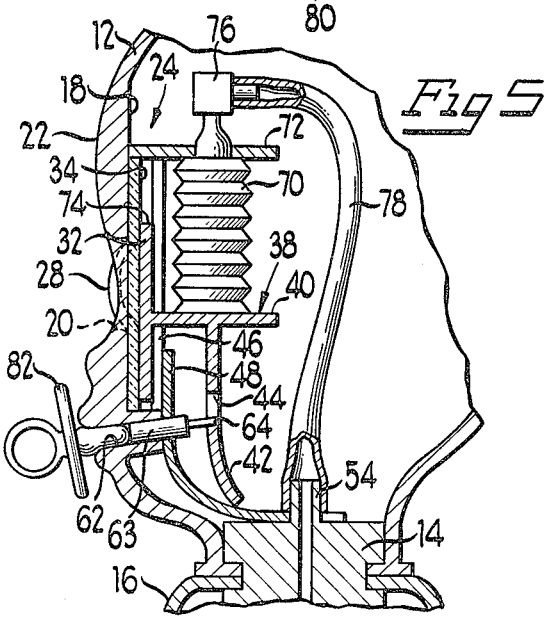
FIG. 5 is a side cross-sectional view taken through the doll's head with the eyes in an eye closed position and with a pacifier inserted in the doll's mouth.
Figure 6:
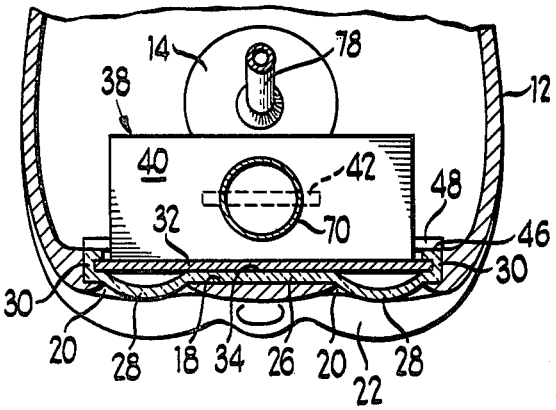
FIG. 6 is a plan cross-sectional view taken through the eyes of the doll.
Figure 9:
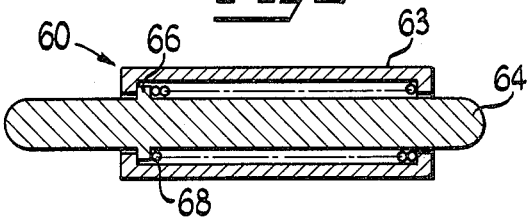
FIG. 9 is an enlarged cross-sectional side view of the pin holder portion of the apparatus of the present invention.

Near the bottom of the doll, a T-shaped pin alignment member 48 is attached to an innermost leg portion 46 of U-shaped sidewalls 30, as shown in FIG. 8. The pin alignment member 48 is secured at or near its lowermost end 50 to the neck plug or structural support member 14 by fitting a pin alignment member support aperture 52 over an upwardly extending nipple portion 54 of neck plug 14 as shown in FIGS. 3–5. The pin alignment member 48 also includes a pin receiving aperture 56 longitudinally aligned with the pin receiving aperture 44 of the elongated leg 42 of T-shaped cross member 38. A pin member designated by reference numeral 60 (FIG. 9) within a mouth aperture 62 in the doll's face 22 and generally includes a stationary annular pin alignment housing 63 having an elongated pin member 64 protruding completely therethrough. A pin 64 includes an annular stop member 66 to retain the pin within the stationary annular pin alignment housing 63. Coil springs 68 are disposed around the pin 64 within the alignment housing 63 to bias the pin 64 toward the mouth aperture 62. The pin member 60 is secured within the mouth aperture 62 of the doll 10 and the stationary annular pin alignment housing 63 is frictionally fit or otherwise secured within the pin receiving aperture 56 of the pin alignment member 48 as shown in FIGS. 3–5. The pin alignment member 48 structurally supports the pin member 60 within its position within the mouth aperture 62 of the doll 10, so that when the pin 64 is pressed inwardly within the doll's head 12 (see FIG. 4) to protrude within the pin receiving aperture 44 of elongated leg member 42 (see FIG. 5), the elongated leg member 42 will be retained in its lower position, as shown in FIG. 5 to retain the eyeball slide member 32 in its eye closed position (FIG. 5) without distorting the mouth area of the doll's face 22.

Figure 2:
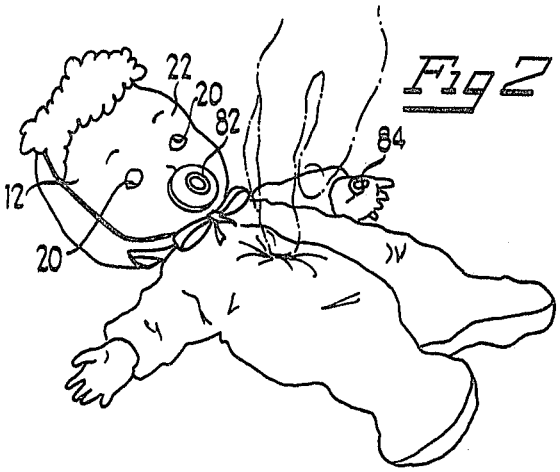
FIG. 2 is a front perspective view of a figure toy or doll constructed in accordance with the features of the present invention shown with its bladder compressed to force the eyes into an eye closed position.

The eyeball slide member 32 is naturally maintained in an eye open position by sealing a bellows member 70 between an upper surface of cross member 40 and a lower surface of bellows support member 72 as shown in FIGS. 3–5. The longitudinal dimension of unexpanded bellows member 70 fixes an upper surface 74 of eye slide member 32 against an under surface of bellows support member 72 to fix the eyeballs 36 in an eye open position so long as the bellows 70 is unexpanded (see FIGS. 3 and 4). The bellows 70 is fluid connected to bladder 16 through an elbow connection 76 disposed to connect the bellows 70 to conduit 78. Conduit 78 fits at its lower end over nipple portion 54 through aperture 80 in neck plug 14 to the bladder 16 in sealed fluid communication. Squeezing the bladder 16, therefore, as shown in FIG. 2, expands the bellows 70, as shown in FIG. 5, to force the eyeball slide member 32 downwardly into an eye closed position. When in this eye closed position, the pin 64 can be forced inwardly within the doll's head to engage pin receiving aperture 44 of elongated leg member 42 to maintain the eyeball slide member 32 in an eye closed position, as shown in FIG. 5. The frictional engagement of the surfaces defining pin receiving aperture 44 against the pin member 64 will retain the eyeball slide means 32 in the eye closed position. In one embodiment shown in FIGS. 2, 4, and 5, the pin member 64 can be compressed to within the doll's head by inserting a pacifier 82 within the doll's mouth 62.

Figure 1:
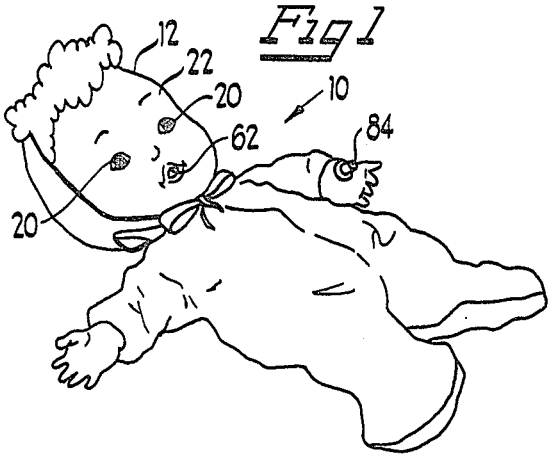
FIG. 1 is a front perspective view of a figure toy or doll constructed in accordance with the principles of the present invention shown in the eye open position.

In accordance with another embodiment of the present invention, the doll 10 can have one of its fingers or thumbs formed into a shape to fit within the mouth aperture 62 so that the thumb 84 (FIGS. 1 and 2) will compress the pin 64 sufficiently within the doll's head to force the pin 64 to within pin receiving aperture 44 of elongated leg member 42.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Apparatus for retaining eyes of a figure toy alternatively in an eye open position or in an eye closed position comprising:

a support means;

an eyeball slide means supported by said support means and longitudinally movable with respect to said support means to an eye open position or an eye closed position;

remotely actuable means connected to said support means for longitudinally moving said eyeball slide means alternatively to an eye open position or an eye closed position; and selectively actuable means connected to said support means for retaining said eyeball slide means in one of said eye positions against movement by said moving means.

2. Apparatus as defined in claim 1 wherein said means for longitudinally moving said eyeball slide means includes a bellows means operatively connected to said eyeball slide means such that adding fluid to said bellows moves said eyeball slide means.

3. Apparatus as defined in claim 1 wherein said means for longitudinally moving said eyeball slide means includes a flexible bladder operatively connected to a bellows means such that compression of said flexible bladder adds fluid to said bellows means thereby causing longitudinal movement of said eyeball slide means.

4. Apparatus as defined in claim 1 wherein said retaining means retains said eyeball slide means in said eye closed position and includes a retaining pin insertable through said support means and into said eyeball slide means.

5. Apparatus as defined in claim 4 said support means including a torso with a head including eye openings, said eyeball slide means movably located within said head to communicate with said eye openings and said retaining means including a pin member disposed within said head and structurally connected to said eyeball slide means.

6. Apparatus as defined in claim 5 wherein said head includes a mouth aperture adapted to receive said pin such that said pin is received within said pin receiving member to retain said eyeball slide means in an eye closed position.

7. Apparatus as defined in claim 1 wherein said support means includes a torso and a head with mouth and eye openings, said retaining means retains said eyeball slide means in said eye closed position and includes a retaining pin secured within said mouth opening spring biased toward said mouth opening and adapted to be pushed within an interior region of said head to engage said eyeball slide means to retain said eyeball slide means in an eye closed position.

8. Apparatus as defined in claim 7 wherein said eyeball slide means includes flat simulated eyeballs thereon.

9. Apparatus as defined in claim 7 wherein said figure toy includes means for pushing said retaining pin formed as part of a hand of said figure toy.

10. Apparatus as defined in claim 7 further including a pacifier adapted to be inserted within the mouth of the figure toy for pushing said retaining pin.

* * * * *